United States Patent [19]

Stang et al.

[11] Patent Number: 4,504,022

[45] Date of Patent: Mar. 12, 1985

[54] THREAD FEED MECHANISM AND METHOD FOR TEXTILE MACHINES

[76] Inventors: Hans-Peter Stang, Wuppertal-Strasse 31; Dieter Fischer, Wuppertal-Strasse 6, both of D-5550 Bernkastel-Kues, Fed. Rep. of Germany

[21] Appl. No.: 471,562

[22] Filed: Mar. 1, 1983

[30] Foreign Application Priority Data

May 5, 1982 [EP] European Pat. Off. ..... 82103867.6

[51] Int. Cl.[3] ..... B65H 51/00

[52] U.S. Cl. ..... 242/47.01; 226/175; 226/190; 474/47

[58] Field of Search ..... 474/37, 39, 43, 46, 474/47; 226/175, 190; 242/47.01

[56] References Cited

U.S. PATENT DOCUMENTS

| | | | |
|---|---|---|---|
| 179,746 | 7/1876 | Wales | 474/33 |
| 794,516 | 7/1905 | Kron | 474/37 |
| 1,350,670 | 8/1920 | Ritter | 474/37 |
| 1,715,595 | 6/1929 | Gouldbourn | 474/37 |
| 2,168,835 | 8/1939 | Wells | 474/46 |
| 2,313,436 | 3/1943 | Hennessy | 474/46 |
| 2,734,390 | 2/1956 | Thelander | 474/46 |
| 3,154,260 | 10/1964 | Stanislao et al. | 242/47.01 |
| 3,444,749 | 5/1969 | Ruprecht et al. | 474/46 |
| 3,516,295 | 6/1970 | Benz et al. | 474/43 |
| 4,149,425 | 4/1979 | Williams | 474/46 |

*Primary Examiner*—Stephen J. Novosad
*Assistant Examiner*—Bruce M. Kisliuk
*Attorney, Agent, or Firm*—Ward Brown; Robert W. Beach

[57] ABSTRACT

An expandable feed roller has two separate side-by-side discs fitted on a rotatable drive shaft. Each disc has circumferentially spaced fins extending inward toward the other disc and inclined toward the shaft. The fins of the two discs are interdigitated to form a thread-receiving valley between them. One of the discs is fixed to the shaft but the other is slidable axially along the shaft toward and away from the other disc so as to change the effective circumference of the base of the thread-receiving valley between the discs. A spring urges the two discs apart against an adjustment mechanism operable to change the relative axial positions of the discs while the drive shaft is rotating.

7 Claims, 2 Drawing Figures

THREAD FEED MECHANISM AND METHOD FOR TEXTILE MACHINES

BACKGROUND OF THE INVENTION

1. Field of the Invention

The present invention relates to thread feed mechanism and a method for feeding weft threads, catch threads or the like in textile machines.

2. Prior Art

For feeding yarn or thread in a textile machine, frequently the yarn or thread is looped one or more times around a driven feed roller and tensioned to prevent slippage. In machines where the feed roller is driven at a constant speed, the speed at which the thread is fed is determined by the circumference of the roller.

"Expandable" feed rollers are known in which side-by-side discs normally fixed to a driven drive shaft have respective inclined, interdigitated fins or fingers forming a valley of alternating inclined fins in which the loop or loops of thread ride. The relative positions of the two discs determine the circumference of the base of the valley and, consequently, the thread feed rate. With the textile machine and the feed roller drive shaft stopped, the mechanism fixing the discs on the drive shaft can be disengaged so that the dics can be moved axially toward or away from each other to change their relative axial positions and, hence, the circumference of the base of the thread-receiving valley formed between them. Spacers of various sizes are used to assure a reasonably precise adjustment from a reference position. By adding or removing spacers, the relative positions of the feed roller discs can be changed in desired increments.

Stopping the textile machine to allow adjustment of the thread feed rate results in loss of production. In addition, experience has shown that the correct spacing of the discs can be determined only after one or more test runs, so that usually more than one adjusting operation is required.

SUMMARY OF THE INVENTION

The principal object of the present invention is to provide improved thread feed mechanism for a textile machine and a method allowing the thread feed rate to be adjusted quickly and easily without stopping the textile machine.

This object can be accomplished by providing a feed roller of the type having separate side-by-side discs with respective interdigitated inclined fingers or fins forming a thread-receiving valley between them, each of such discs being rotated with a drive shaft but at least one of them being movable axially along the drive shaft by manipulation of adjustment mechanism while the drive shaft is rotating.

In the preferred embodiment of the invention, one of the discs is fixed to the drive shaft and the other disc is urged away from the fixed disc by a spring. The adjustment mechanism includes a bell crank pivoted on the stationary frame of the textile machine and having one of its arms connected to the movable feed roller disc through a thrust bearing. The other arm of the bell crank bears against a set screw that can be turned to adjust the position of the movable roller disc relative to the fixed disc.

DETAILED DESCRIPTION

Figure 2:
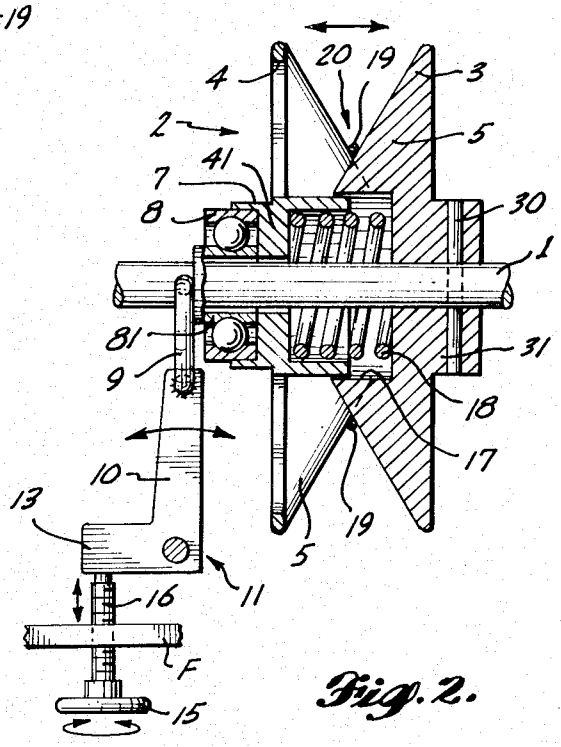
FIG. 2 is a somewhat diagrammatic top plan of the mechanism of FIG. 1, parts being shown in section and parts being broken away.
Figure 1:
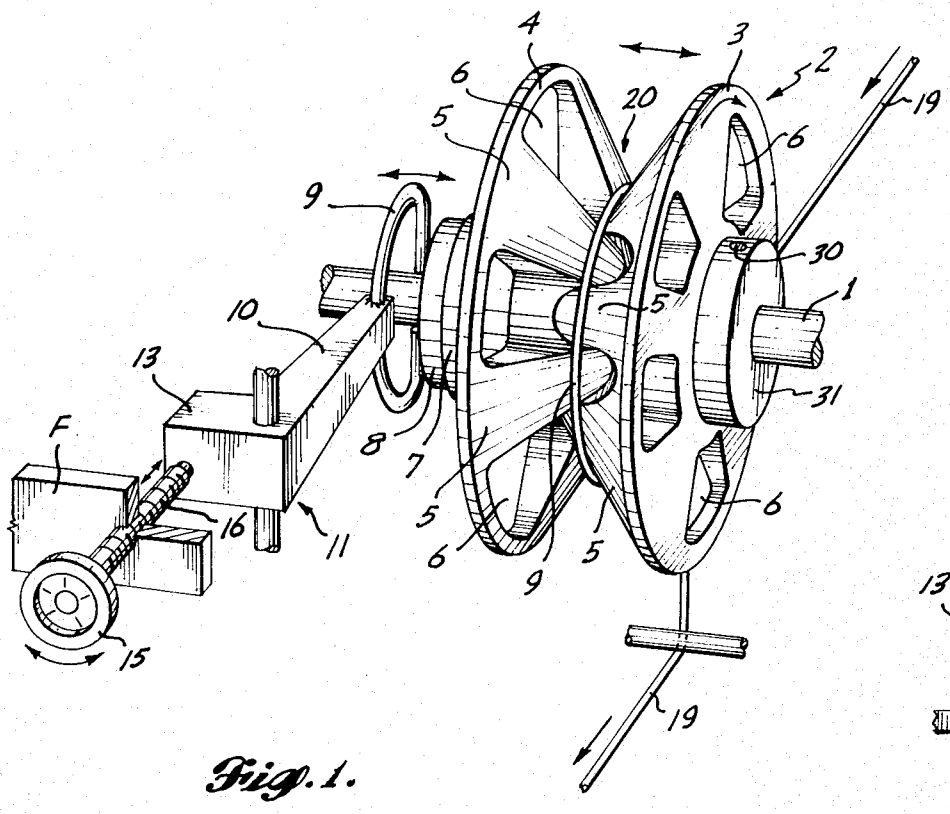
FIG. 1 is a somewhat diagrammatic top perspective of thread feed mechanism in accordance with the present invention, parts being broken away.

As shown in the drawings, the thread feed mechanism in accordance with the present invention includes a feed roller 2 formed of two separate side-by-side discs 3 and 4 fitted on a driven shaft 1 of a textile machine. Each of the discs has respective circumferentially spaced fingers or fins 5 extending inward toward the other disc and inclined toward the shaft 1. The inner end portions of the fins of each disc are received in the gaps 6 between the fins of the other disc.

Disc 3 is fixed to the shaft 1, such as by a pin 30 extending through registered bores through the outward projecting portion of its hub 31 and the shaft 1. In contrast, disc 4, though rotated with the drive shaft, is slidable axially along the shaft. A helical compression spring 18 encircling the shaft bears against the facing inner surfaces of the respective hubs 31 and 41 of the two discs 3 and 4 in a central recess 17 urging the two discs apart.

A thrust bearing 8 is fitted in an outward opening recess of the outward projecting portion of hub 7 of disc 4 and includes an inner race 81 loosely encircling the shaft 1. The inner ends of a U-shaped coupling 9 bear against the outer end of the inner race of the bearing. A bell crank 11 pivotally mounted on the stationary frame of the textile machine for swinging about an axis perpendicular to but offset from the axis of shaft 1 has an inward projecting arm 10 fixed to the central portion of the coupling 9. The other arm 13 of the bell crank projects generally perpendicular to the inward projecting leg 10 and has its outer face bearing against the inner end of a setscrew 16 threaded through the textile machine stationary frame F.

The yarn or thread 19 to be fed by use of the present invention is looped one or more times in the base of the groove or valley 20 formed by the interdigitated inner end portions of the fins of the two discs. During operation of the textile machine, turning the setscrew 16 by its knurled, enlarged outer head 15 swings the inward projecting leg 10 of the bell crank 11 to the left or right, as indicated in FIG. 2. Since the position of the disc 3 is fixed, the disc 4 is slid axially along the shaft 1 in the corresponding direction either against the force of the compression spring 18 or by the force of such spring. Relative axial movement of the two discs toward each other increases the effective circumference of the base of the thread-receiving valley between the two discs and also increases the yarn or thread feed rate. Similarly, relative axial movement of the two discs away from each other decreases the effective circumference of the base of the thread-receiving valley between the two discs, thereby decreasing the thread feed rate.

Since the adjustment can be made while the shaft is rotating, the textile machine need not be stopped repeatedly to obtain a desired feed rate.

We claim:

1. In thread feed mechanism for textile machines including a drive shaft, means for rotating the drive shaft and a thread feed roller separate from the drive shaft rotating means and having two separate side-by-side discs mounted on such shaft, each of such discs having circumferentially spaced fins extending inward toward the other disc and inclined toward the shaft, the inner end portions of the fins of the two discs being interdigitated to form a thread-receiving valley between them flared outward from its base, the improvement comprising one of the discs being fixed to the drive shaft and the other disc being fitted on the shaft so as to be slidable axially therealong, and adjustment means mounted on the textile machine for changing the axial position of such other slidable disc relative to such fixed disc while the drive shaft is rotating so as to change the effective circumference of the base of the thread-receiving valley between the discs and thereby change the thread feed rate without stopping the drive shaft and without changing the speed of rotation of the drive shaft.

2. In thread feed mechanism for textile machines including a drive shaft, means for rotating the drive shaft and a thread feed roller separate from the drive shaft rotating means and having two separate side-by-side discs mounted on such shaft, each of such discs having circumferentially spaced fins extending inward toward the other disc and inclined toward the shaft, the inner end portions of the fins of the two discs being interdigitated to form a thread-receiving valley between them flared outward from its base, the improvement comprising one of the discs being fixed to the drive shaft and the other disc being fitted on the shaft so as to be slidable axially therealong, such discs having respective hub portions with facing inner surfaces located inward of the interdigitated fins adjacent to the drive shaft, a helical compression spring encircling the drive shaft and bearing against the facing inner surfaces of the disc hub portions for biasing the discs apart, and adjustment means mounted on the textile machine and connected to such other slidable disc for normally retaining such other slidable disc in fixed relationship relative to such fixed disc, said adjustment means being actuatable in a first direction while the drive shaft is rotating so as to move such other slidable disc toward such fixed disc against the force of said compression spring and thereby increase the effective circumference of the base of the thread-receiving valley between the discs, and said adjustment means being actuatable in a second direction so as to allow movement of such other slidable disc away from such fixed disc by the force of said compression spring and thereby decrease the effective circumference of the base of the thread-receiving valley between the discs, whereby said adjustment means permit the effective circumference of the base of the thread-receiving valley between the discs to be changed so as to change the thread feed rate without stopping the drive shaft and without changing the speed of rotation of the drive shaft.

3. In the feed mechanism defined in claim 2, the adjustment means including a bell crank having one arm rotatably coupled to the slidable disc and another arm projecting from such one arm, and the adjustment means further including means bearing against the second arm and operable to swing the bell crank for changing the relative axial positions of the two discs.

4. In the mechanism defined in claim 3, the bell crank being pivotable about a fixed axis substantially perpendicular to but offset from the axis of the drive shaft.

5. In the mechanism defined in claim 2, the slidable disc hub portion having an outward opening recess, a bearing fitted in said recess, the adjustment means including a coupling attached to said bearing and means for moving said coupling to change the relative axial positions of the two discs.

6. In the mechanism defined in claim 5, the coupling being U-shaped and having inner end portions secured to the bearing, a bell crank having one arm fixed to the coupling generally centrally between its ends, and means for swinging the bell crank about an axis extending transversely of but offset from the axis of the drive shaft.

7. The method of feeding a thread in a textile machine having a rotating drive shaft which comprises mounting a thread feed roller on the drive shaft for rotation therewith, such feed roller having two separate side-by-side discs each with circumferentially spaced fins extending inward toward the other disc and inclined toward the shaft, the inner end portions of the fins of the two discs being interdigitated so that the fins form a thread-receiving valley between them flared outward from its base and one of the discs being fixed to the drive shaft and the other disc being slidable axially therealong, winding the thread around the feed roller in the base of its thread-receiving valley for feeding the thread by friction exerted on the thread as the feed roller rotates, and sliding the slidable disc axially of the drive shaft so as to adjust the relative axial positions of the discs and thereby change the effective circumference of the base of the thread-receiving valley to change the rate at which the thread is fed without stopping the drive shaft and without changing the speed of rotation of the drive shaft.

* * * * *